United States Patent [19]

Kawamata

[11] Patent Number: 4,998,638

[45] Date of Patent: Mar. 12, 1991

[54] CAN AND METHOD OF MANUFACTURING THE SAME

[75] Inventor: Seizi Kawamata, Ohmiya, Japan

[73] Assignee: Nihon Seikan Kabushiki Kaisha, Saitama, Japan

[21] Appl. No.: 849,368

[22] Filed: Apr. 7, 1986

Related U.S. Application Data

[63] Continuation of Ser. No. 724,789, Apr. 18, 1985, abandoned, which is a continuation of Ser. No. 539,959, Oct. 7, 1983, abandoned.

[30] Foreign Application Priority Data

Oct. 26, 1982 [JP] Japan ..... 57-187864

[51] Int. Cl.[5] ..... B65D 6/30; B65D 51/18

[52] U.S. Cl. ..... 220/626; 270/85 B; 270/256; 270/270; 215/270; 426/407

[58] Field of Search ..... 220/256, 258, 68, 66, 220/85 B, 270; 215/270, 271, 350; 426/397, 396, 406, 407

[56] References Cited

U.S. PATENT DOCUMENTS

| | | | |
|---|---|---|---|
| 1,832,669 | 11/1931 | Thomas | 220/256 |
| 2,027,438 | 1/1936 | Karl | 220/258 |
| 2,040,798 | 5/1936 | Schoonmaker | 215/271 |
| 2,049,264 | 7/1936 | Karl | 220/258 |
| 2,267,422 | 12/1941 | Rakowitzky | 220/258 |
| 2,751,073 | 6/1956 | Sheeran | 220/85 B |
| 3,283,941 | 11/1966 | Rollins | 220/270 |
| 3,394,840 | 7/1968 | Pecci | 220/68 |
| 3,425,591 | 2/1969 | Pugh | 220/270 |
| 4,122,964 | 10/1978 | Morris | 215/270 |

FOREIGN PATENT DOCUMENTS

| | | | |
|---|---|---|---|
| 1014627 | 8/1952 | France | 220/85 B |
| 51-16200 | 12/1976 | Japan . | |
| 54-34983 | 3/1979 | Japan . | |
| 58-40020 | 9/1983 | Japan . | |
| 1043649 | 6/1964 | United Kingdom | 220/68 |

*Primary Examiner*—George E. Lowrance
*Attorney, Agent, or Firm*—Wenderoth, Lind & Ponack

[57] ABSTRACT

A can has a film which is stretched on the inside of an end plate thereof so as to be deflectable in and out of contact with the end plate so that the can which has heated contents packed and sealed therein can be prevented from deformation caused as the contents cool down. The above-mentioned can is manufactured by overlaying the end plate and the film one on top of the other and then unitarily securing the end brim of the can body and the peripheral edge portion of the end plate to each other by double seaming, with the film disposed on the inside of the end plate.

12 Claims, 4 Drawing Sheets

CAN AND METHOD OF MANUFACTURING THE SAME

This application is a continuation of now abandoned application Ser. No. 724,789, filed Apr. 18, 1985, which is a continuation of now abandoned application Ser. No. 539,959, filed Oct. 7, 1983.

BACKGROUND OF THE INVENTION

1. Field of the Invention

The present invention relates to a can and a method of manufacturing the same and, more particularly, to a can having a film stretched on the inside of an end plate constituting the can so that the film is deflectable in and out of contact with the end plate, and a method of manufacturing the same.

2. Description of the Prior Art

Hitherto, a can having a can body made of a material relatively small in pressure resistance, such as paper, synthetic resin sheet, metal foil and so forth, often encounters such a problem that in the case where heated contents are packed and sealed in such a can, the can body is undesirably depressed owing to a negative pressure produced in the can as the contents cool down.

For overcoming the above-mentioned problem, such a technique has been known that the end plate of the can is artificially depressed when the contents have cooled down to some extent to produce a large negative pressure.

By such a technique, however, it is not possible to absorb a negative pressure produced after the end plate is artificially depressed (for instance, in the case where the contents are packed at 92° C. and the end plate is artificially depressed at 65° C., although any negative pressure produced before the depression can be absorbed, it is not possible to absorb a negative pressure produced as the contents cool down to a temperature lower than 65° C.); hence, there are still possibilities that the can body may be depressed.

SUMMARY OF THE INVENTION

Accordingly, an object of the invention is to provide a can improved to be capable of preventing any depression of the can body caused by a negative pressure produced in the can body as the contents packed and sealed therein at a high temperature cool down to normal temperatures.

Another object of the invention is provide a method which makes it possible to manufacture the above-mentioned can extremely easily according to the ordinary procedure without any increase in number of the double seaming steps.

To these ends, according to one aspect of the invention, there is provided a can comprising a film stretched on the inside of an end plate thereof, with a predetermined space maintained therebetween, and secured to the end plate at its edge portion.

Moreover, according to another aspect of the invention, there is provided a method of manufacturing the above-mentioned can, the method comprising: overlaying a film on one side of the above-mentioned end plate; and unitarily securing an end brim of a can body and the peripheral edge portion of the end plate by double seaming, with the film disposed on the inside of the end plate.

More specifically, according to the invention, a film is stretched on the inside of an end plate of a can, with a predetermined space maintained therebetween. Therefore, any negative pressure can be absorbed by the deformation of the film. In addition, the space between the end plate and the film offers a cushioning effect. Accordingly, the effect of a negative pressure on the can body is reduced to succeed in preventing any depression. Moreover, since the end plate and the film are simultaneously double seamed, it has been achieved to extremely easily obtain a can having a film sealed and stretched therein.

The above and other objects, features and advantages of the invention will become apparent from the following description of the preferred embodiments taken in connection with the accompanying drawings.

DESCRIPTION OF THE PREFERRED EMBODIMENTS

Figure 1:
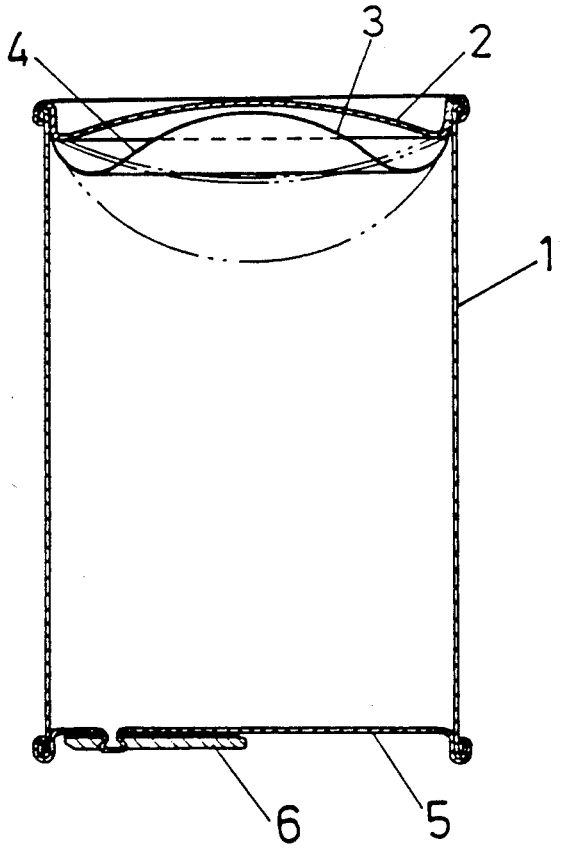
FIG. 1 is a sectional view of an embodiment of the can in accordance with the invention.

The invention will be described hereinunder through an embodiment shown in FIG. 1.

A can body 1 (made from paper, synthetic resin sheet or metal foil) has an end plate 2 of upwardly curved cross-section and a synthetic resin film 4 of upwardly curved cross-section provided on the inside of the end plate 2, with a slight space 3 maintained therebetween. The end plate 2 and the synthetic resin film 4 are secured at their peripheral edges to the upper end brim of the can body 1 by double seaming. On the other hand, an end plate 5 is secured to the lower end of the can body 1. In the drawing, a reference numeral 6 denotes a tab member for opening the can.

Figure 2:
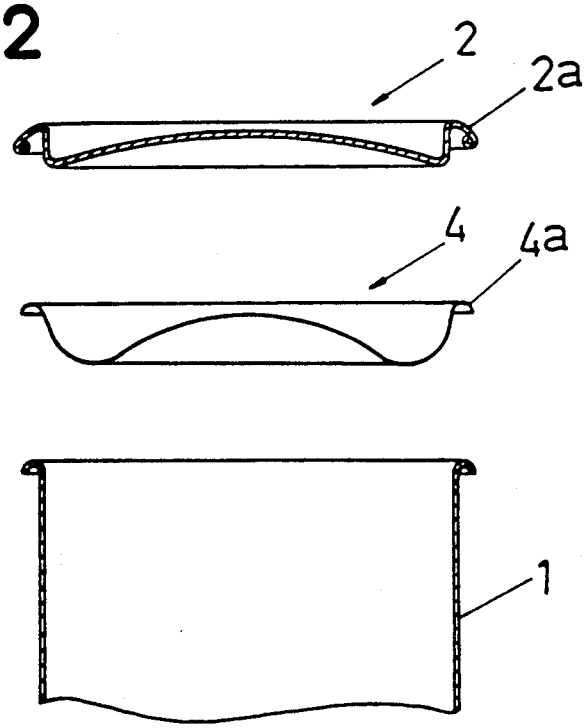
FIG. 2 is an exploded sectional view of the can shown in FIG. 1, with some parts thereof omitted, for describing a first embodiment of the method of manufacturing the can in accordance with the invention.

The following is the description of an embodiment of the method of manufacturing the can shown in the above embodiment in accordance with the invention as shown in FIG. 2.

The synthetic resin film 4 of upwardly curved cross-section and having a collar 4a for double seam formed at its peripheral edge is overlaid on the concave surface of the end plate 2 of upwardly curved cross-section and having a collar 2a for double seam formed at its peripheral edge, with the slight space 3 maintained therebetween. In this case, the synthetic resin film 4 is fitted to the end plate 2 so as to be tentatively secured thereto. Next, the end plate 2 and the synthetic resin film 4 overlaid one on top of the other are fitted to the upper end opening of the can body 1. Then, the collars 2a, 4a of the end plate 2 and the synthetic resin film 4, respectively, are overlaid one on top of the other and secured to the upper end brim of the can body 1 by double seaming. After the packing of contents, the end plate 5 is secured to the lower end brim of the can body 1 by double seaming to complete a packed can.

According to the can shown in FIG. 1 of the above embodiment, in the case where heated contents are packed in the can, when a negative pressure is produced as the contents cool down, the synthetic resin film 4 is sucked by the negative pressure and gradually deformed inwardly of the can. Since a negative pressure is produced in the space 3 with the deformation of the film 4, when this negative pressure reaches a predetermined value (e.g., when the contents packed at 92° C. have cooled down to 65° C.), the end plate 2 is depressed by an external force (shown by a chain line in FIG. 1) to absorb the negative pressure. If a negative pressure is further produced owing to the cooling of the contents after the depression, the film 4 is deformed (shown by another chain line in FIG. 1) to absorb the negative pressure. Therefore, the can body 1 can maintain its original shape. It is to be noted that since the air in the space 3, when it is sealed between the film 4 and the end plate 2, is at normal temperatures, there is little probability that a negative pressure will be produced in the space 3 when the contents cool down after packing.

On the contrary, since the air in the space inside the can is heated by the contents, a relatively large negative pressure is produced as the contents cool down.

Figure 3:
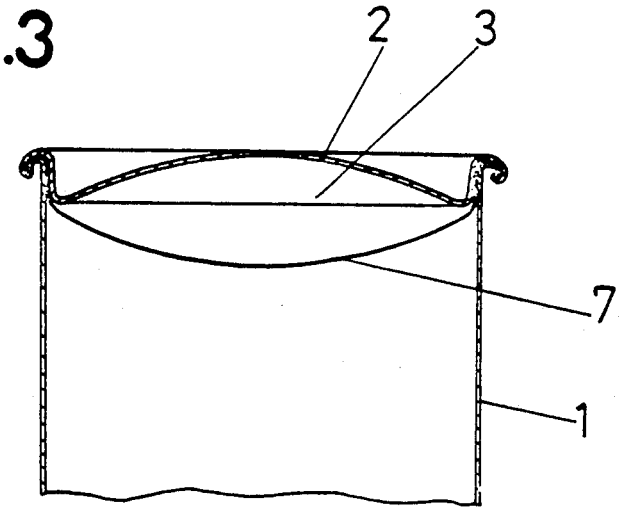
FIG. 3 is a sectional view of the can shown in FIG. 1, with some parts thereof omitted, in a tentatively double seamed state, for describing a second embodiment of the method in accordance with the invention.
Figure 4:
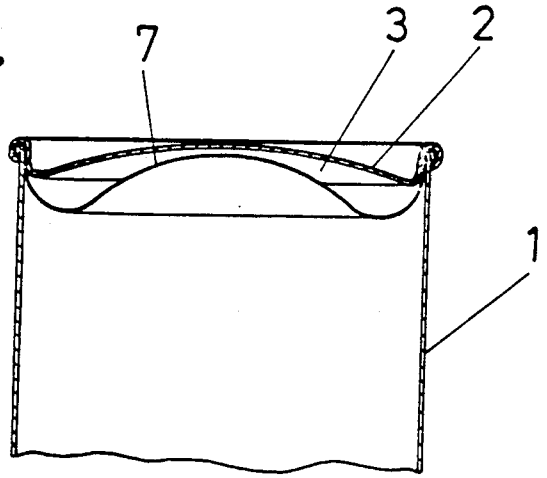
FIG. 4 is a sectional view of the can shown in FIG. 1, with some parts thereof omitted, in a finally double seamed state, for describing the second embodiment of the method in accordance with the invention.

Although the synthetic resin film 4 employed in the above-described manufacturing method is a film formed to have an upwardly curved cross-section, it is possible to manufacture the can in accordance with the invention as shown in FIG. 3 and 4 by employing a synthetic resin film 7 formed to have a downwardly curved cross-section. In such a case, as shown in FIG. 3, after the end plate 2 and the synthetic resin film 7 tentatively secured together are tentatively secured to the upper end opening of the can body 1 by double seaming, the central portion of the synthetic resin film 7 is projected toward the end plate 2 as shown in FIG. 4. Since the air in the space 3 is discharged to the outside through the tentatively double seamed portion, the central portion of the synthetic resin film 7 is easily projected upwardly.

Thereafter, the tentatively double seamed portion is finally double seamed to manufacture the can shown in FIG. 1. The can manufactured by this method has the synthetic resin film 7 primarily formed to have a downwardly curved cross-section. Therefore, the film 7 is easily deformed inwardly of the can by a negative pressure. In addition, a large amount of deformation can be expected.

Accordingly, it is possible to well absorb any negative pressure inside the can.

Figure 5:
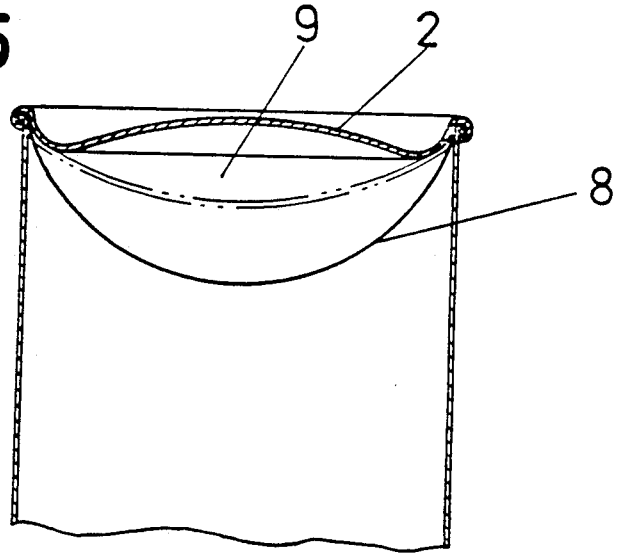
FIG. 5 is a sectional view of another embodiment of the can in accordance with the invention, with some parts thereof omitted.

In another embodiment of the can in accordance with the invention shown in FIG. 5, the peripheral edge of the end plate 2 of upwardly curved cross-section and that of a synthetic resin film 8 of downwardly curved cross-section are unitarily secured to the upper end brim of the can body 1 by double seaming. According to this embodiment, it has been found that the pressure in the space 9 between the end plate 2 and the film 8 is made positive by the expansion of the air in the space 9, to apply a pressing force to the inside of the can. It is to be noted that if the end plate 2 is depressed by an external force, the pressure in the space 9 is made more positive to apply a larger pressing force to the inside of the can, thereby offering a larger effect.

Figure 6:
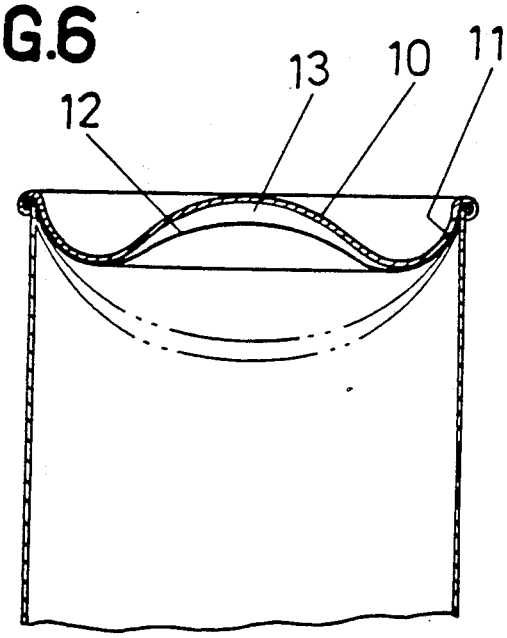
FIG. 6 is a sectional view of still another embodiment of the can in accordance with the invention, with some parts thereof omitted, in which an end plate is allowed to be automatically depressed.

In still another embodiment of the can in accordance with the invention shown in FIG. 6, an end plate 11 downwardly curved in cross-section but having an upwardly convex portion in its center and a synthetic resin film 12 having a shape substantially equal to that of the end plate 11 are overlaid one on top of the other, with a space 13 maintained therebetween, and are secured to the upper end brim of the can body by double seaming. The upwardly convex portion 10 of the end plate 11 is made smaller in thickness than the periphery thereof so that the upwardly convex portion 10 can be depressed without applying any external force. Therefore, the upwardly convex portion 10 is automatically depressed with the production of a negative pressure inside the can.

Figure 7:
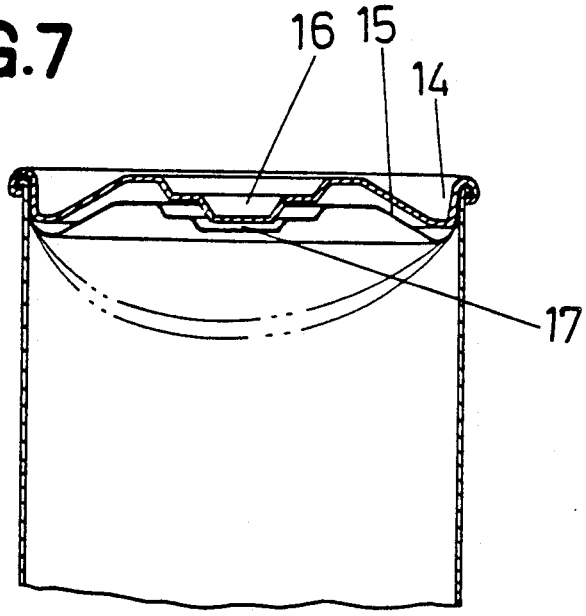
FIG. 7 is a sectional view of a further embodiment of the can in accordance with the invention, with some parts thereof omitted, in which an end plate is provided with a stepwise recessed portion.

In a further embodiment of the can in accordance with the invention shown in FIG. 7, an upwardly convex end plate 14 and synthetic resin film 15 are provided in their centers with stepwise recessed portions 16, 17, respectively. According to this embodiment, it is possible to enlarge the surface areas of the end plate 14 and the synthetic resin film 15. Therefore, larger amounts of deformation can be obtained by depression (when depressed both the end plate and synthetic resin film are formed into curved surfaces), so that if a relatively large negative pressure is produced in the can, the negative pressure can be well absorbed.

Although the end plate and the synthetic resin film are unitarily secured to the upper end brim of the can body in the above embodiments, it is not always necessary to unitarily double seam both of them and such a structure is possible that the peripheral edge portion of the synthetic resin film is bonded to the end plate and only the end plate is secured to the upper end brim of the can body by double seaming. According to the method in which the end plate and the synthetic resin film are overlaid one on top of the other and secured to the upper end brim of the can body by double seaming, the can in accordance with the invention can be extremely easily manufactured without any increase in the number of the securing steps. In addition, if the end plate is formed to have an upwardly curved cross-section, a larger negative pressure can be absorbed by depressing the end plate. However, is it not necessary to form the end plate with an upwardly curved shape in cross-section. Moreover, as the film, it is possible to employ any flexible, or rigid synthetic resin film or any metal foil film as long as it is non-air-permeable.

Figure 8:
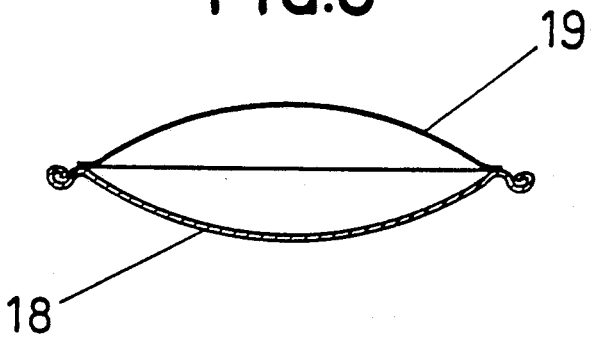
FIG. 8 is a sectional view of a still further embodiment of the can in accordance with the invention, in which an end plate and a synthetic resin film are tentatively secured together.
Figure 9:
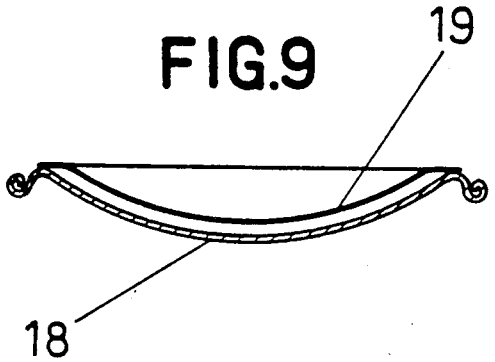
FIG. 9 is a sectional view of the can shown in FIG. 8 in a double seamed state.
Figure 10:
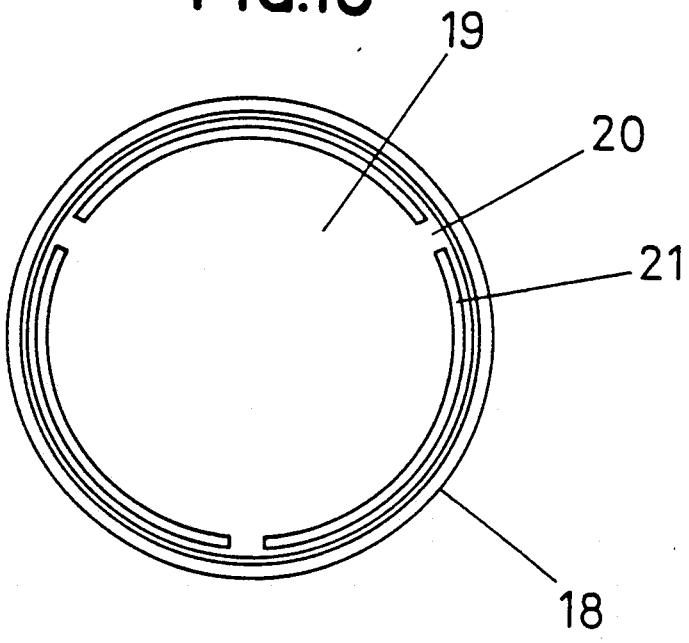
FIG. 10 is a plan view of the can shown in FIG. 8.

Moreover, FIGS. 8 to 10 in combination show a still further embodiment of the invention in which the peripheral edge of a synthetic resin film 19 is overlaid on that of an end plate 18, and the overlaid portions are tentatively secured together. In this case, as shown in FIG. 9, if the synthetic resin film 19 is brought close to the end plate 18 and then the end plate 18 is double seamed, film 19 and end plate 18 can be handled as if they were a unitary body. Therefore, an extremely excellent workability is obtained. In FIG. 10, a reference numeral 20 denotes each of non-welded portions, while a numeral 21 represents each of welds. The non-welded portions 20 serve as air vents.

As has been described, in the can in accordance with the invention, the film is stretched on the inside of the end plate of the can body so as to be deflectable in and out of contact with the end plate. Therefore, any negative pressure produced inside the can is absorbed by the deformation of the film due to the suction by the negative pressure. In addition, the space defined between the end plate and the film offers a cushioning effect. As a result, the effect of a negative pressure applied to the can body is reduced, and it is possible to prevent any undesirable depression of the can body. Moreover, according to the method of the invention, the end plate and the film are overlaid one on top of the other and then secured to the end brim of the can body. Accordingly, a can having a film stretched therein can be extremely easily obtained according to an ordinary procedure without any increase in the number of the double seaming steps.

Although the invention has been described through specific terms, it is to be noted here that the described embodiments are not exclusive and various changes and modifications may be imparted thereto without departing from the scope of the invention which is limited solely by the appended claims.

What is claimed is:

1. In a can to be packed with heated contents, said can including a can body formed of a material having a relatively low pressure resistance and opposite first and second ends to be sealingly closed, the improvement comprising means for, upon cooling of the heated contents, preventing deformation of said can body as a result of the generation therein of negative pressure, said preventing means comprising closure means for covering a first said end of said can body while absorbing said negative pressure, said closure means comprising:

an imperforate end plate having a periphery sealingly secured to said can body and a nonplanar, nonperforated central portion, said end plate being formed of a material capable of being deformed inwardly;

an imperforate flexible film member stretched across said can body inwardly of said end plate and having a periphery secured to said periphery of said end plate, said film member being formed of a material capable of inward deflection upon the generation within said can body of said negative pressure; and a predetermined sealed space maintained between said end plate and said film member and forming cushioning means for, upon initial inward deflection of said film member resulting from initial negative pressure within said can body due to initial cooling of contents therein, followed by inward deformation of said end plate, enabling further inward deflection of said film member to absorb further negative pressure generated within said can body due to further cooling of contents therein, without deformation of said can body.

2. The improvement claimed in claim 1, wherein said central portion of said end plate is curved upwardly.

3. The improvement claimed in claim 1, wherein said film member is formed of synthetic resin film or metal foil.

4. The improvement claimed in claim 1, wherein said film member has an upwardly or downwardly curved cross-sectional configuration.

5. The improvement claimed in claim 1, wherein said peripheries of said end plate and said film member are secured to said can body by double seaming.

6. The improvement claimed in claim 1, further comprising a rigid end plate closing a second said end of said can body, said rigid end plate having a tab member for opening said can.

7. In a method of manufacturing a can to be packed with heated contents and including a cam body formed of a material having a relatively low pressure resistance and opposite first and second ends to be sealingly closed, the improvement comprising sealingly covering a first said end of said can body while preventing deformation of said can body as a result of the generation therein of negative pressure resulting from cooling of heated contents therein, said improvement comprising:

sealingly securing to said can body the periphery of an imperforate end plate having a nonplanar, nonperforated central portion and formed of a material capable of being deformed inwardly;

stretching a an imperforate flexible film member across said can body inwardly of said end plate and securing the periphery of said film member to said periphery of said end plate, said film member being formed of a material capable of inward deflection upon the generation within said can body of negative pressure; and defining and maintaining between said end plate and said film member a predetermined sealed space, thereby forming a cushion capable of, upon initial inward deflection of said film member resulting from initial negative pressure within said can body due to initial cooling of contents therein, followed by inward deformation of said end plate, ensuring further inward deflection of said film member of to absorb further negative pressure generated within said can body due to further cooling of contents therein, without deformation of said can body.

8. The improvement claimed in claim 7, wherein said central portion of said end plate is curved upwardly.

9. The improvement claimed in claim 7, wherein said film member is formed of synthetic resin film or metal foil.

10. The improvement claimed in claim 7, wherein said film member has an upwardly or downwardly curved cross-sectional configuration.

11. The improvement claimed in claim 7, further comprising securing said peripheries of said end plate and said film member to said can body by double seaming.

12. The improvement claimed in claim 7, further comprising closing a second said end of said can body by means of a rigid end plate having a tab member for opening the can.

* * * * *